United States Patent [19]

White

[11] Patent Number: 4,880,242

[45] Date of Patent: Nov. 14, 1989

[54] GAME APPARATUS AND METHOD OF PLAYING A GAME USING THE SAME

[76] Inventor: Ordie S. White, 3922 41st St., New Brighton, Pa. 15066

[21] Appl. No.: 160,731

[22] Filed: Feb. 26, 1988

[51] Int. Cl.[4] ..... A63B 67/06; A63B 65/00

[52] U.S. Cl. ..... 273/336; 273/427; 273/428

[58] Field of Search ..... 273/336, 337, 338, 339, 273/427, 428

[56] References Cited

U.S. PATENT DOCUMENTS

| | | | |
|---|---|---|---|
| D. 86,590 | 3/1932 | Adams | 273/427 X |
| D. 152,984 | 3/1949 | Koches | 273/427 X |
| 1,097,035 | 5/1914 | Lee | 273/336 |
| 1,646,627 | 10/1927 | Mossman et al. | 273/427 |
| 1,683,643 | 9/1928 | Wittmaak | 273/427 X |
| 3,507,496 | 4/1970 | Miller | 273/339 |

*Primary Examiner*—William H. Grieb

*Attorney, Agent, or Firm*—Kirkpatrick & Lockhart

[57] ABSTRACT

A gaming apparatus which includes a game projectile and a vertical post and a method of employing the same are provided. The game projectile is generally H-shaped and includes a central bar member and first curved legs extending therefrom. Second curved legs are also connected to the central bar member and are more curved than the first legs so as to define a smaller opening between the second legs than that provided between the first legs. Differing point values may be ascribed depending upon whether the game projectile, after projection toward the vertical post, comes to rest with the post being within one or other of the areas bounded by the legs of the game projectile.

20 Claims, 2 Drawing Sheets

GAME APPARATUS AND METHOD OF PLAYING A GAME USING THE SAME

BACKGROUND OF THE INVENTION

1. Field of the Invention

The present invention relates to games and, in particular, to a projectile game apparatus and method of playing a game using the same in which differing point values may be ascribed to the game activity depending on the skill of the player.

2. Description of the Invention Background

Various games have been heretofore developed in which a game projectile is projected toward an object with a point value being ascribed to the resulting proximity of the game projectile to the object. For example, in the classic game of horseshoes, a player projects a U-shaped game projectile toward a vertical post. Differing point values are ascribed depending on whether the horseshoe surrounds the post or whether the inner surface of the horseshoe touches the post. However, in the classic game of horseshoes, the horseshoe only defines a single opening and a single area which may receive the post.

In addition to the classic game of horseshoes, other games have been developed which involve a player's projecting a game projectile toward a post or scoring structure. For example, Adams (Des. U.S. Pat. No. 86,950) relates to a scoring disc for a ring and horseshoe game. The scoring disc is generally circular and includes an internal ring and an area which is defined by extended legs. However, Adams does not disclose the provision of a game projectile having two open ends of differing sizes.

Koches (Des. U.S. Pat. No. 152,984) relates to a combined quoit and horseshoe pitching device. The apparatus disclosed in Koches comprises a #-shaped device. Scoring is determined depending on whether the post is within one of the four regions defined between the legs of the device or within the central ring thereof. However, the distances between each of the respective pairs of legs of the device shown in Koches are identical.

Lee (U.S. Pat. No. 1,097,035) relates to an indoor game device having a game projectile which is projected toward a vertical post. The device disclosed in Lee includes first and second open ends of identical dimensions and a central internal bounded area. Similarly, Wittmaak (U.S. Pat. No. 1,683,643) discloses a disc-like game projectile having four peripheral openings and a central open area. However, the peripheral openings are all of identical dimensions.

The subject invention is directed toward an improved game which requires a heightened degree of skill to more quickly amass scoring points.

SUMMARY OF THE INVENTION

In accordance with the present invention, there is provided a gaming apparatus and a method of using the same which provides a challenging and unusual game. The gaming apparatus comprises a generally H-shaped body which is projected toward a vertical post. The game projectile comprises a central bar having four legs extending therefrom. A first pair of legs extends from the central bar in a first direction. Such first legs are generally curved inwardly and terminate in inwardly facing heels. Accordingly, the distance between the first heels comprises a primary opening while a first area is defined between the first heels, the first legs and the central bar member.

In addition, a second pair of legs are connected to the central bar member and extend therefrom in a direction opposite from the first legs. The second legs are shorter in length and are more inwardly curved than the first legs. The second legs terminate in inwardly extending second heels. As such, a secondary opening is defined between the innermost points of the second heels and a second area, which is smaller than the first area, is defined between the second heels, the second legs and the central bar member.

In playing the game according to the present method, a player projects the game projectile toward a vertical post. In the event the game projectile lands with the first area surrounding the post, a first point value, e.g., three (3) points, is ascribed. If the game projectile comes to rest with the post being within the second area, a second point value, e.g., five (5) points, is ascribed. The game may continue until a predetermined total of points is reached.

Accordingly, the present invention provides a novel and exciting game wherein differing point values are ascribed depending on the skill of the player in projecting the game projectile toward a vertical post. As differing point values may be ascribed depending on which of the areas of the game projectile bound the post, a more challenging game is provided.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENT

Figure 1:
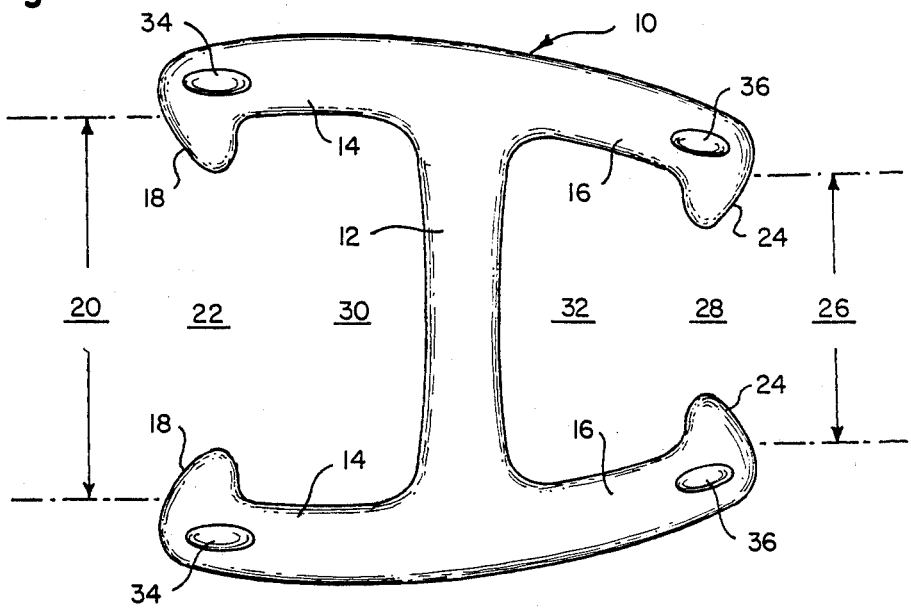
FIG. 1 is a plan view of the game projectile according to the present invention.
Figure 2:
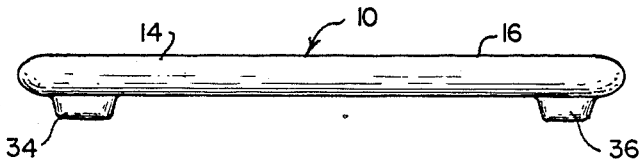
FIG. 2 is a side elevation view of the game projectile according to the present invention.

Referring now to the drawings wherein the showings are for purposes of illustrating a present preferred embodiment of the invention only and not for purposes of limiting same, the Figures show a game projectile 10 which is employed in combination with a vertical post 11 in order to play the present game. It will be appreciated that the vertical post 11 may be retained within the ground or mounted on a separate supporting base.

More particularly, and with reference to FIG. 1, there is shown the game projectile 10 which is generally formed in the shape of a modified "H". The game projectile 10 is generally planar with the exception of the vertically extending lugs described hereinbelow. The game projectile 10 includes a central bar member 12 from which extend first legs 14 and second legs 16.

First legs 14 are connected to the ends of central bar member 12 such that they extend generally perpendicularly therefrom. However, first legs 14 are preferably slightly curved toward one another. Each of the first legs 14 includes a heel portion 18. Heel portions 18 are provided on the free ends of first legs 14 and are provided to extend toward one another so that the distance between the true ends of first legs 14, which comprises a first opening 20, is modified to form a smaller primary opening 22. Accordingly, there is provided a first area 30 which is bounded by primary opening 22, first heels 18, first legs 14 and central bar member 12.

Second legs 16 are also connected to and extend generally perpendicularly from the ends of central bar member 12. Second legs 16 are preferably shorter in length than first legs 14 and are more inwardly curved toward one another than first legs 14. Each of the second legs 16 are provided with a second heel 24. Second heels 24 are connected to each of the second legs 16 and comprise generally inwardly facing projections therefrom. Accordingly, the normal second opening 26 between the second legs 16 is lessened by the second heels 24 to a secondary opening 28 between the innermost points of the second heels 24. As such, a second area 32 is provided which is bounded by secondary opening 28, second heels 24, second legs 16 and central bar member 12.

Each of the first legs 14 and second legs 16 are preferably provided with upwardly extending lug members. In particular, first lugs 34 are provided on the upper surfaces of each of the first legs 14. Similarly, second lugs 36 are preferably provided on the upper surfaces of second legs 16. Applicant has discovered that the provision of the first lugs 34 and the second lugs 36 enhances the flight of the game projectile 10 and provides additional rigidity and support to their respective legs. In addition, the first lugs 34 and second lugs 36 serve to stop the game projectile 10 when it lands on the ground or other mounting for vertical post 11.

The game projectile 10 may be formed of various materials. It may be formed from a metallic substance such as iron or steel. In the event the game projectile 10 is formed from a metallic substance, it is preferred that the weight thereof be between 2 pounds-6 ounces and 2 pounds-9 ounces. Alternatively, the game projectile 10 may be formed from a plastic or rubber material which is especially suitable for indoor use or for use by children.

Figure 3:
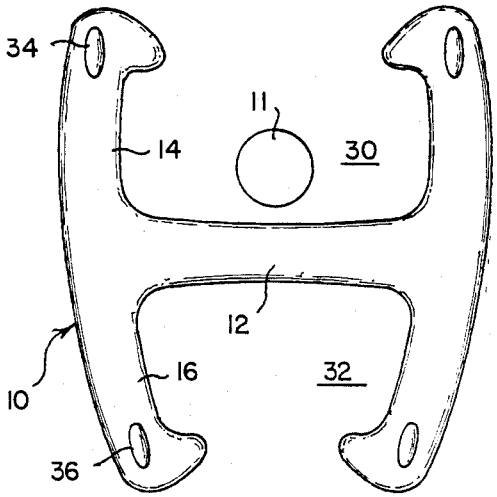
FIG. 3 is a view of the game projectile provided herein in a first scoring position.
Figure 4:
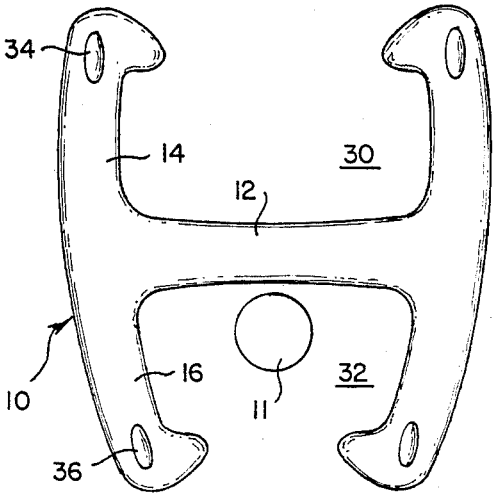
FIG. 4 is a plan view of the game projectile provided herein in a second scoring position.

In accordance with the game which is to be played employing the game projectile 10 and the post 11, a player positions himself at a distance from the post 11. Such distance may be between thirty (30) and forty (40) feet. However, it will be appreciated that a player may stand at any distance from post 11 which provides a challenge for him to cause either first area 30 or second area 32 to surround post 11. The player then projects the game projectile 10 toward the post 11. As noted above, the object of the present game is to cause the game projectile 10 to land in proximity to post 11 such that post 11 is bounded by first area 30 or second area 32. For example, as depicted in FIG. 3, if the projectile 10 comes to rest in proximity to post 11 such that the post 11 is bounded by first area 30, a first point value, e.g., three (3) points, may be ascribed to the player's effort. On the other hand, as depicted in FIG. 4, if the game projectile 10 comes to rest with the post 11 bounded within second area 32, a higher point value may be ascribed, e.g., five (5) points. While the present game may comprise either one or more projections of the game projectile 10 toward post 11, such variations are intended to fall within the scope of the present invention.

It will be understood that various changes in the details, materials and arrangements of parts which have been herein described and illustrated in order to explain the nature of the invention may be made by those skilled in the art within the principle and scope of the invention as expressed in appended claims.

What is claimed is:

1. A game projectile comprising:

a. a central bar member;

b. two first legs connected to and extending generally perpendicularly from the ends of said central bar member such that the distance between the ends of said first legs remote from said central bar member comprises a first opening;

c. two second legs connected to and extending generally perpendicularly from the ends of said central bar member in a direction generally away from said first legs, such that the distance between the ends of said second legs remote from said central bar member comprises a second opening which is smaller than said first opening; and d. said first legs being inwardly curved toward one another to form said first opening and said second legs being inwardly curved toward one another to form said second opening.

2. The game projectile of claim 1 in which:

a. said first legs comprise first heel members connected to the ends of said first legs remote from said central bar member, said first heel members being coplanar with said first legs and extending into said first opening so as to provide a primary opening between the innermost portions of said first heels which is smaller than said first opening; and b. said second legs comprise second heel members connected to the ends of said second legs remote from said central bar member, said second heel members being coplanar with said second legs and extending into said second opening so as to provide a secondary opening between the innermost portions of said second heels which is smaller than said second opening and said primary opening.

3. The game projectile of claim 2 in which the area bounded by said primary opening, said first heel members, said first legs and said central bar member is greater than the area bounded by said secondary opening, said second heel members, said second legs and said central bar member.

4. The game projectile of claim 3 further comprising:

a. a pair of first vertical lugs with one of said first lugs being connected to the end of each of said first legs remote from said central bar member and on the same side of said game projectile; and b. a pair of second vertical lugs, with one of said second lugs being connected to the end of each of said second legs remote from said central bar member and on the same side of said game projectile as said first lugs.

5. The game projectile of claim 4 in which said game projectile is formed from a metallic material.

6. The game projectile of claim 4 in which said game projectile is formed from iron.

7. The game projectile of claim 4 in which said game projectile is formed from steel.

8. The game projectile of claim 4 in which said game projectile is formed from a plastic material.

9. The game projectile of claim 4 in which said game projectile is formed from a rubber material.

10. A game apparatus comprising:

a. a vertical post; and b. a game projectile comprising:
(i) a central bar member;
(ii) two first legs connected to and extending generally perpendicularly from the ends of said central bar member such that the distance between the ends of said first legs remote from said central bar member comprises a first opening;
(iii) two second legs connected to and extending generally perpendicularly from the ends of said central bar member in a direction generally away from said first legs, such that the distance between the ends of said second legs remote from said central bar member comprises a second opening which is smaller than said first opening; and
(iv) said first legs being inwardly curved toward one another to form said first opening and said second legs being inwardly curved toward one another to form said second opening.

11. The game apparatus of claim 10 in which:
a. said first legs of said game projectile comprise first heel members connected to the ends of said first legs remote from said central bar member, said first heel members being coplanar with said first legs and extending into said first opening so as to provide a primary opening between the innermost portions of said first heels which is smaller than said first opening; and
b. said second legs of said game projectile comprise second heel members connected to the ends of said second legs remote from said central bar member, said second heel members being coplanar with said second legs and extending into said second opening so as to provide a secondary opening between the innermost portions of said second heels which is smaller than said second opening and said primary opening.

12. The game apparatus of claim 11 in which, in said game projectile, the area bounded by said primary opening, said first heel members, said first legs and said central bar member is greater than the area bounded by said secondary opening, said second heel members, said second legs and said central bar member.

13. The game apparatus of claim 12 in which said game projectile further comprises:
a. a pair of first vertical lugs with one of said first lugs being connected to the end of each of said first legs remote from said central bar member and on the same side of said game projectile; and
b. a pair of second vertical lugs, with one of said second lugs being connected to the end of each of said second legs remote from said central bar member and on the same side of said game projectile as said first lugs.

14. The game apparatus of claim 13 in which said game projectile is formed from a metallic material.

15. The game apparatus of claim 13 in which said game projectile is formed from iron.

16. The game apparatus of claim 13 in which said game projectile is formed from steel.

17. The game apparatus of claim 13 in which said game projectile is formed from a plastic material.

18. The game apparatus of claim 13 in which said game projectile is formed from a rubber material.

19. A method of playing a game comprising:
a. providing a vertical post and a game projectile, said game projectile comprising a central bar member, two first legs connected to and extending generally perpendicularly from the ends of said central bar member such that the distance between the ends of said first legs remote from said central bar member comprises a first opening, and said first opening, said first legs and said central bar member define a first area, and two second legs connected to and extending generally perpendicularly from the ends of said central bar member in a direction generally away from said first legs, such that the distance between the ends of said second legs remote from said central bar member comprises a second opening which is smaller than said first opening, and said second opening, said second legs and said central bar member define a second area which is smaller than said first area, said first legs being inwardly curved toward one another to form said first opening and said second legs being inwardly curved toward one another to form said second opening;
b. projecting said game projectile toward said vertical post from a distance; and
c. ascribing differing point values depending on whether said vertical post is within said first area or said second area after said game projectile comes to rest.

20. A method of playing a game comprising:
a. providing a vertical post and a game projectile, said game projectile comprising a central bar member, two first legs connected to and extending generally perpendicularly from the ends of said central bar member, said first legs being curved inwardly toward one another, each of said first legs having a first coplanar heel member connected to the end thereof remote from said central bar member, said first heel members extending toward one another such that a primary opening is defined between the innermost portions of said first heel members, and a first area is defined by said primary opening, said first heel members, said first legs and said central bar member, and two second legs connected to and extending generally perpendicularly from the ends of said central bar member in a direction generally away from said first legs, said second legs being curved inwardly toward one another, each of said second legs having a second heel member connected to the end thereof remote from said central bar member, said second heel members extending toward one another such that a secondary opening is defined between the innermost portions of said second heel members with said secondary opening being smaller than said primary opening, and a second area is defined between said secondary opening, said second heel members, said second legs and said central bar member, said second area being smaller than said first area;
b. projecting said game projectile toward said vertical post from a distance; and
c. ascribing point differing values depending on whether said vertical post is within said first area or said second area after said game projectile comes to rest.

* * * * *